United States Patent [19]

Brown

[11] 4,063,839

[45] Dec. 20, 1977

[54] EXPANSION JOINT WITH ELASTOMER SEAL

[75] Inventor: Delmont D. Brown, North Baltimore, Ohio

[73] Assignee: The D. S. Brown Company, North Baltimore, Ohio

[21] Appl. No.: 599,407

[22] Filed: July 28, 1975

[51] Int. Cl.[2] ..... E01C 11/02

[52] U.S. Cl. ..... 404/69; 52/396; 49/475

[58] Field of Search ..... 404/68, 67, 47, 64, 404/69; 52/395, 396, 403; 49/475

[56] References Cited

U.S. PATENT DOCUMENTS

| | | | |
|---|---|---|---|
| Re. 26,733 | 12/1969 | Welch | 404/67 |
| 3,363,522 | 1/1968 | Galbreath | 404/67 |
| 3,372,521 | 3/1968 | Thom | 404/47 X |
| 3,677,145 | 7/1972 | Wattiez | 404/47 |
| 3,854,835 | 12/1974 | Stog | 404/68 |
| 3,880,539 | 4/1975 | Brown | 404/68 X |
| 3,904,303 | 9/1975 | Becht | 404/68 |

*Primary Examiner*—Nile C. Byers

*Attorney, Agent, or Firm*—Keil, Thompson & Shurtleff

[57] ABSTRACT

An expansion joint with an elastomer seal having longitudinal frames made from aluminum extrusions extending longitudinally of an expansion joint for pavements and bridge decks. The longitudinal frames are mounted by anchor bolts in the pavement or bridge deck concrete, which pavement or bridge deck has a concrete or asphaltic wear surface. The elastomer seal is fixedly held in the longitudinal frames by elongated tongue and groove means, and the joint space is spanned by at least one shallow, V-shaped elastomer wall which deforms downwardly as the joint width becomes narrower. The longitudinal frames are held in position in steps in the concrete adjacent to the joint by the anchor bolts, which have threaded ends projecting upwardly into an upwardly facing longitudinal channel and the hollow space of a hollow segment of substantially square cross section in the respective longitudinal frames. Access to the threaded ends of the anchor bolts in the hollow segment is gained through openings having removable covers, which openings are provided in the top wall of the hollow segment.

8 Claims, 4 Drawing Figures

EXPANSION JOINT WITH ELASTOMER SEAL

The subject invention concerns improvements in expansion joint structures useful in the spanning of relatively narrow joints in pavement surfaces, particularly joints in pavement decks of bridges. The latter joints have a relatively narrow range of movement, i.e., opening and closing, during expansion and contraction of sections of a bridge deck as the environmental temperature changes.

Expansion joints for bridges heretofore have involved heavy assemblies or subassemblies brought to the bridge site and mounted in the bridge joints by cranes or the like. One well known type of bridge expansion joint comprises a pair of heavy duty plates fixedly attached to opposite sides of the joint. The plates have projecting, interfitting fingers which span the joint and can move relative to each other if the joint opens or closes. Joints of this type cannot be effectively sealed against leakage of water from rain or melted ice or snow. The latter two in particular carry with them corrosive salts which, over a period of time, damage the superstructure of the bridge, its piers, and/or abutments.

Bridge designers and engineers have been giving more attention in recent years to use of bridge joints which are sealed against leakage of water and/or solids through the joint onto the underlying structure of the bridge. A relatively recent design for a sealed bridge joint embodies longitudinal, spaced rails resting on joint-spanning beams. Laterally compressible elastomer seals are compressed between the rails slightly below the upper surface thereof. The upper surfaces of the rails lie substantially in the plane of the bridge deck. The tires of automobiles crossing the joint run across these upper surfaces of the rails while the elastomer seals are recessed enough to avoid contact with the automobile tires.

These known expansion joints are manufactured and preassembled at an off-site facility, compressed to a width allowing them to be inserted in the joint, hauled to the bridge site and laid in the joint with heavy duty cranes. Once installed, they are difficult to repair. Repair or replacement of a component usually involves closing the entire bridge or several lanes thereof to traffic in order that heavy duty equipment may be brought to the joint site to raise the expansion joint, repair it, and replace it back in the joint.

THE INVENTION HEREIN

This invention provides improvements in expansion joint structures useful as bridge deck and pavement joints. The joint structure comprises a pair of opposed, elongated, side frames, preferably formed as aluminum extrusions. The side frames respectively have a side wall and a bottom wall with an upwardly facing, longitudinal, first groove in the bottom wall. This groove has opposed horizontal legs.

A second longitudinal groove, also opening upwardly, is formed at the juncture of the side and bottom walls and has a horizontal lip spaced from but extending toward the side wall. These grooves receive and hold deformable, longitudinal, tongues or beads projecting downwardly from the respective sides of an elastomer seal and tread extending completely across the joint between the respective side walls of the side frames.

The joint opening itself is spanned by at least one, preferably two, shallow, V-shaped, elastomer walls attached to the respective side portions of the tread and seal. The V-shaped wall or walls bend progressively into deeper V-shape configuration as the joint closes.

The respective side frames are rigidly mounted along the longitudinal edge portion of the joint formed in the pavement or bridge deck, e.g., concrete sections with a spacing therebetween to accommodate contraction and expansion of the respective sections and/or their underlying support structure.

The side frames preferably are fabricated as aluminum alloy extrusions. Each extrusion is relatively light in weight so that the joint may be assembled easily at the joint site without using heavy duty equipment. The frames are of relatively short lengths, e.g., 12 feet, or other length corresponding approximately to the width for one lane of traffic of the road or bridge. This feature allows the joint to be constructed or repaired on a one lane at a time basis, while keeping other lanes open to traffic flow during maintenance. The side frame sections preferably have a gasket between abutting ends to seal the abutting ends against seepage of water at these points.

The abutting ends with the gasket therebetween utilize bracket and bolt means of the type shown in my U.S. Pat. No. 3,880,539 for drawing the frame sections together and compressing the gasket therebetween.

The elastomer seal and tread is a continuous piece without joints subject to leakage and extends the full width and length of the joint. The longitudinal tongues or beads on the underside of the seal and tread snap into the upwardly facing channels or grooves in the manner aforedescribed.

As additional features for guarding against seepage of moisture or incompressible particles between the side walls of the respective frames and the abutting faces of the seal and tread, the side wall of each frame and the respective side portion of the tread are provided with interlocking, longitudinal, sawtoothed serrations. Also, the side frames preferably have a small longitudinal lip overlying the upper corner of each side portion of the tread and seal. A positive seal against moisture penetrating the joint is provided by positive compression of the tongue or bead neck portions at the entry of the upwardly facing channels or grooves.

The frames are anchored in the concrete by anchor bolts. For this purpose the joint-remote portion of the frames is composed of an upwardly projecting, substantially rectangular, frame segment having a substantially rectangular longitudinal cavity. The upper threaded ends of the anchor bolts, which project downwardly into the concrete, extend through openings drilled in the bottom wall at longitudinal spaced intervals into the cavity. These anchor bolts are secured by upper and lower nuts on the threaded portion thereof. Access to the upper nut may be made by drilling coaxial holes in the upper wall of the hollow side segment of the frames for purposes of tightening or removing the upper nuts positioned within the hollow cavity. Such holes in the upper wall are plugged against entrance of water into the cavity by sealing plugs removably inserted in such holes. Such plugs may have threaded, blind holes of a size and coaxial position so that the upper, threaded end of the anchor bolts may be threaded into the blind holes to secure the plugs in position.

Downwardly depending, additional anchor bolts may be mounted on the bottom wall of the frame at longitudinally spaced intervals at positions closer to the joint by drilling another series of longitudinally spaced holes in the bottom wall of the frames, i.e., the portion of the bottom wall which lies beneath an outer edge of the elastomer joint seal and tread. Such anchor bolts are secured by upper and lower nuts, the upper nut of which preferably lies in an upwardly facing, longitudinal channel provided on the upper surface of the bottom wall. Such channel provides a hollow space immediately below the channel-overlying portion of the elastomer tread and seal for accommodation of the upper nuts and the upper, threaded ends of the anchor bolts.

In some areas, particularly in Europe, bridge decks are made with an underlying concrete layer and an asphalt overlay. Such concrete-asphalt constructions are often provided with a water-impermeable membrane of suitable plastic or synthetic rubber between the concrete and asphalt layers. For such constructions the invention further provides an elongated, flange member having a first flange underlying the joint-remote segment of each side frame. Such flange is bolted by the lower nuts of the first-described series of anchor bolts to the underside of each frame. A body portion with a transversely concave upper surface projects downwardly and outwardly from the joint-remote end of each frame. The water impermeable membrane between the concrete and asphalt layers is laid on the transversely concave surface and continues up to the joint-remote side wall of the frames to provide a continuous water impermeable seal between the concrete and asphalt layers up to the joint-remote side of the frames.

If desired, the body portion may have a segment of downwardly increasing thickness and an outwardly and downwardly facing side. Such segment of increasing thickness as a lipped longitudinal channel of T-cross section in the latter side. The lipped channel slidably receives therein nuts into which may be threaded additional anchor bolts which project downwardly and outwardly into the concrete. The nuts are slidable to any desired position in the channel. They are locked in place by threading the threaded ends of the anchor bolts into the nuts until the end of the anchor bolts bind against the opposing wall of the channel.

The objects and advantages of the invention will be further appreciated from the following description of preferred embodiments of the invention, which are illustrated in the drawings, wherein.

Figure 1:
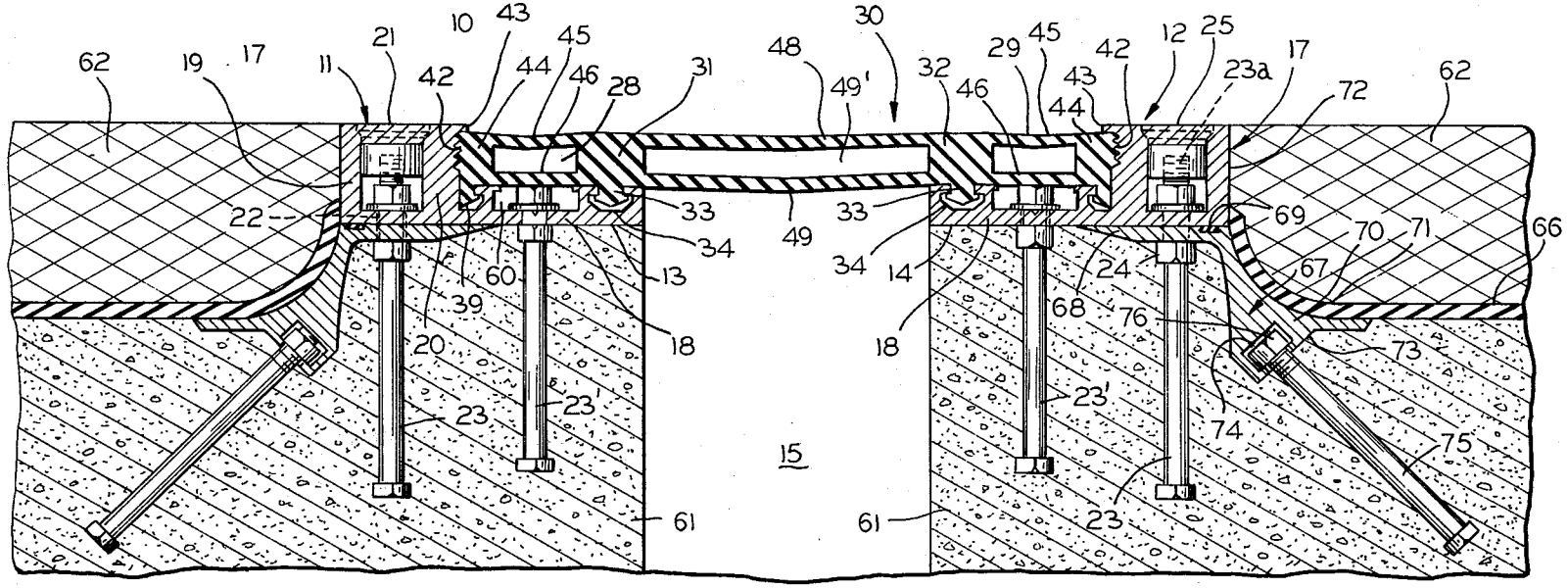
FIG. 1 is a fragmentary cross section view of an expansion joint of a concrete bridge deck having an asphalt overlay with longitudinal side frames anchored at the upper corners of the joint and with an elastomer seal and tread mounted in the respective side frames and extending across the joint.
Figure 2:
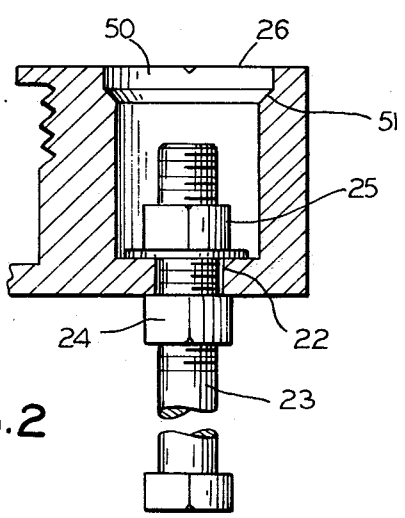
FIG. 2 is a fragmentary cross section of a segment of the side frame without the water-sealing plug and without the flange member for accommodating a water impermeable membrane.

Referring to the drawings, FIGS. 1 and 2 illustrate a joint and seal 10 which is set in place prior to the pouring of the concrete pavement of the bridge deck. It comprises an elongated side frame 11 and an opposed, elongated side frame 12. The respective side frames are supported recessed steps 13 and 14 which are formed when the concrete is poured at the joint, usually with the frames in place. The respective concrete sections have therebetween a space 15 forming an expansion joint accommodating expansion of the concrete sections and/or the underlying support structure therefor.

The joint-remote side of the frames 11 and 12 is a hollow, longitudinally elongated, side segment 17 having a rectangular, longitudinal cavity 16 formed by the joint-adjacent side wall 19, the joint-remote portion **18*a* of the bottom wall 18, the joint-remote side wall 20, and the top wall 21. The segment 17** has a substantially rectanular or square transverse cross section with a rectangular opening therein.

The bottom wall portion **18*a* has bolt-passage openings 22 drilled therein at longitudinally spaced intervals. Downwardly-extending anchor bolts 23 having a threaded end 23*a* extending through the respective openings 22 are secured on the bottom wall portion 18*a* by nuts 24 and 25. Coaxial bolt-access holes 26 of larger diameter than the openings 22 are drilled in the top wall 21. These holes are plugged by removable plugs 27 which are described in greater detail hereinafter. Additional downwardly-extending anchor bolts 23' having threaded ends may be attached by nuts 24 and 25** to the bottom wall.

The side frames are spanned both transversely and longitudinally by the seal and tread 30, which preferably is an elastomer extrusion of a low crystallization type neoprene formulation. It is optionally provided with longitudinally hollow sections 28 and 29 positioned in the seal and tread above the respective bottom walls 18 of the side frames. The seal and tread has solid elastomer sections 31 and 32 contiguous to the joint space 15. These solid sections each have a downwardly depending, deformable, elastomer, longitudinal, dovetailed tongue or bead 33 which can be pressed into and interlocked in a longitudinal slot 34 in the upper surface of the bottom wall 18 of each side frame. The longitudinal slot 34 has inwardly facing, opposed lips 35 and 36 which interlock and hold the tongue or bead in the respective slots 34 after the tongue or bead has been pressed into the slots 34.

Near the juncture of the side wall 20 and the bottom wall 18, each side frame has an inverted L-leg 37 forming a longitudinal slot 38 which opens upwardly. The seal and tread 30 is provided along each side edge thereof with a downwardly depending, dovetailed tongue 39 corresponding in cross section to one-half of the tongues or beads 33. The inverted L-leg 37 in each side frame forms a horizontal lip 40 (FIG. 2) extending toward but spaced from the side walls 16. The lip 40 interlocks with the tongue 39 after the latter has been pressed into the longitudinal slot 38.

Preferably both the upper portion of the outer face of the side wall 20 and the upper portion of the sides of the seal and tread 30 have longitudinal, sawtoothed-like serrations 42 which serve a sealing function to prevent seepage of water and incompressibles between the side wall 20 and the ends of the tread and seal 30. Also, each side frame 11 and 12 preferably has a small longitudinal lip 43 overlying the upper corners of the seal and tread 30 to hold the latter in position as traffic passes over the joint. Such lips further serve an incompressible and water-sealing function, particularly in concert with the serrations 42. The neck portions of the longitudinal tongues or beads 39 may be wider than the entrant portions of their respective slots (between the edge of the lip 40 of L-leg 37 and side wall 20) for tight seating of the tongues or beads in their slots.

The side portions of the tread and seal 30 preferably include solid, elastomer segments 44 which are respectively joined with the solid, elastomer segments 32 by a thin upper wall 45 and a thin lower wall 46 thereby defining the longitudinal cavities or hollow spaces 28 and 29.

In the joints of the subject invention, the joint width is spanned in its entirety with at least an upper, connecting web or wall 48 having a shallow V-configuration which can become progressively deeper as the joint narrows in width. Preferably the solid sections 31 and 32 are connected not only by the upper wall or web 48 but also by a lower wall or web 49 with a longitudinal cavity or space 50 formed between these walls. The cavity or space 49' is provided to accommodate the downwardly deflecting center segment of the upper wall 48 as the joint narrows to its narrowest width.

The side sections 11 and 12 are placed at the joint prior to pouring the concrete sections 61. The elastomer seal and tread 30 is mounted in the side frames after the concrete has set.

The plugs 27 are seated in the drilled holes 26 in the upper wall 21. The holes 26 preferably constitute a cylindric upper portion 50 and a tapered lower portion 51. The plugs 27 comprise a cylindric body 52 having an annular upper flange 53. A ring gasket 54 is compressed between the lower side of the flange 53 and the tapered seat 51 (which may be a planar, annular ring) of the holes 26 as a seal against entrance of moisture into the cavity 16. The plug 26 has a threaded blind hole 55 extending coaxially thereof from the bottom, circular wall 56 of the plug. A threaded blind hole is threaded onto the projecting threaded end of the respective anchor bolt 23 until the ring gasket 54 is compressed. The plug may be turned by a spanner wrench, for which small holes 57 and 58 are provided in the circular, upper face 59 of the plugs.

The second series of anchor bolts 23' have a threaded end projecting into an upwardly facing channel 60 in the upper surface of the bottom wall 18. This channel together with the bottom wall 46 of the elastomer thread and seal forms a longitudinal cavity in the overall assembly, which cavity is sealed against penetration or entrance of water by the overlying seal structure.

Figure 3:
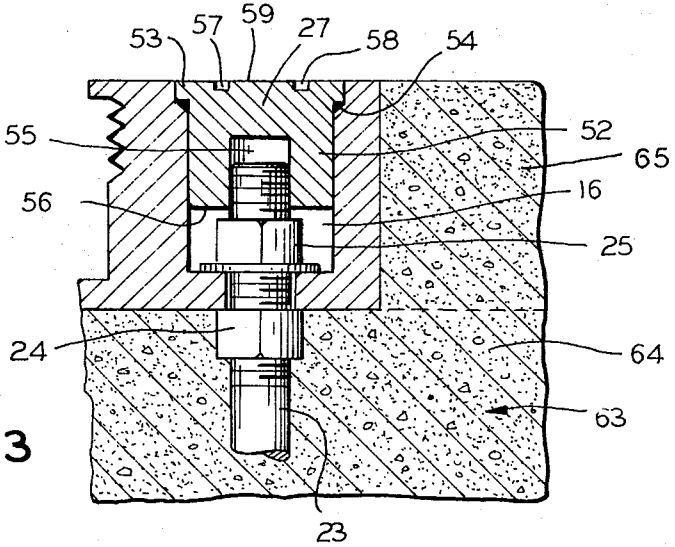
FIG. 3 is a fragmentary cross section of the same segment of the side frame mounted in a bridge deck, which is shown in fragment.
Figure 4:
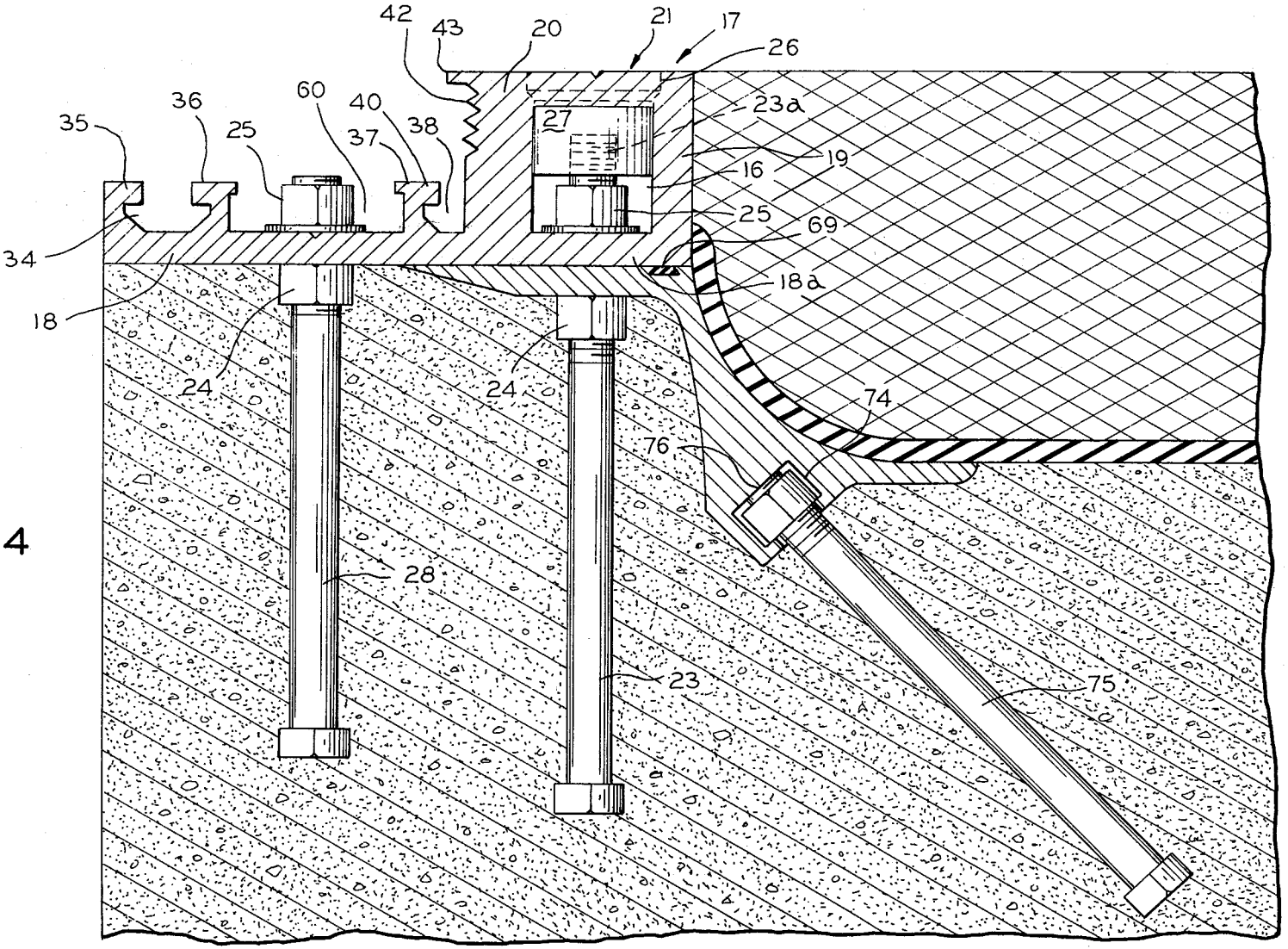
FIG. 4 is an enlarged cross section of the right hand side of the joint of FIG. 1, without the elastomer seal and tread mounted in the side frame, in the bridge deck.

As shown in FIGS. 1 and 4 the bridge deck may have a concrete underlayer 61 and an asphalt or concrete upper layer or wear course 62. Alternatively, the bridge deck may constitute a unitary concrete layer 63 as shown in FIG. 3 or, as indicated by the broken line, the bridge deck structure may have a lower concrete layer 64 with a concrete or asphalt overlay 65.

In the embodiment illustrated in FIGS. 1 and 4 a sealing membrane 66 which is water impermeable is laid between the concrete lower layer 61 and the asphalt or concrete wear course 62. To assure continuance of the water impermeable membrane between the two layers in the vicinity of the side frames of the joint, an auxiliary membrane-support structure 67 may be attached to the underside of each side frame. Such auxiliary structure is composed of a first flange 68 which underlies the bottom wall portion 18*a* of each side frame. This flange is secured to the underside of each side frame by the lower nuts 24 of the bolts 23. The upper surface of the flange 68 has a longitudinal groove in which is mounted a sealing strip 69 serving as a moisture seepage stop between the joint-remote edge of each side frame and the membrane supporting member 67.

Should it be desired to remove the seal and tread and side frames of the joint structure, this may be accomplished readily by first removing the elastomer tread and seal 30 thereby exposing the upper nuts 25 for removal thereof from the anchor bolts 23'. The plugs 27 are removed whereupon the head of a socket wrench can be inserted through the openings 26 to remove the nuts 25. Thereafter the side frames can be lifted out of the steps 13 and/or 14 in the joint face.

The body portion 70 of the member 67 has a transversely concave upper wall 71 on which the membrane 66 is laid, such membrane covering the concave wall 71 and extending to the joint remote, substantially vertical face 72 of each side frame. The latter face has a slight, transverse taper from its top edge to its bottom edge to make it easier to release the side frame from the pavement surface abutting the said face.

The body portion 70 has a downwardly and outwardly facing wall or face 73 in which is provided a longitudinal, lipped, T-groove or channel 74. This channel is used to mount downwardly and outwardly sloping anchor bolts in the member 70. The latter is achieved by sliding nuts 76 into the channel 74 and positioning the nuts in the channel at spacings desired for the respective anchor bolts 75. The anchor bolts are then threaded into the nuts until their ends bind against the opposing face or wall 76 of the channel 74, thereby locking the nuts and anchor bolts at the desired longitudinal spacings along the dovetailed channel 74. Such membrane supporting members and their anchor bolts are mounted on the respective side frames prior to mounting of the side frames on the bridge deck structure and prior to pouring of the concrete layer 61.

The transverse or width and degree of concavity of the upper wall 71 is such that its lower, outer, substantially horizontal edge is positioned at a depth corresponding substantially to the depth or thickness of the upper layer 62, i.e., a depth at the interface between the concrete underlayer 61 and upper layer 62. Since such depth varies from state to state, job to job and country to country, a plurality of member-support structures 67 of different sizes and/or cross-sections are needed to accommodate the aforesaid depth variations.

Abutting ends of the side frames in the bridge deck structure preferably have therebetween an elastomer gasket of the type described in my U.S. Pat. No. 3,880,539. Such gaskets may be compressed between the abutting ends by the use of bracket and bolt structures of the type illustrated in FIGS. 5 and 6 of the patent. The bolts which hold the brackets are accommodated by holes drilled in the bottom wall segment 18*a* adjacent respective ends of the side frames. The nuts for such bolts can be tightened by access in the respective ends of the longitudinal cavities 16. Preferably, however, bracket and bolt structures of the type shown in FIGS. 7 and 8 of the patent may be used for compressing the gaskets between abutting ends of the side frames. The bracket-bolt structures of FIGS. 7 and 8 can be removed after the concrete of the underlayer 61 has set and hardened whereas the bracket-bolt structures of FIGS. 5 and 6 remain embedded in the concrete and thereby make more difficult subsequent removal of the side frames as aforedescribed.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. An expansion joint frame structure with an elastomer seal and tread comprising a pair of opposed, elongated, side frames adapted to be removably mounted on respective steps in the upper corners of horizontally spaced members of a pavement or a bridge deck expansion joint by vertically extending anchor bolts anchored to said members, an elongated elastomer seal removable mounted on said side frames and extending therebetween, said side frames each having a bottom wall adapted to rest on a step in the pavement or bridge deck in the respective upper corners of the joint and further having a joint-remote, elongated segment of substantially rectangular transverse cross section with a longitudinal cavity of substantially rectangular cross section therein, the bottom side of said cavity having a first series of longitudinally spaced holes through which protrude respective, threaded, upper ends of said vertically extending anchor bolts, nuts threaded on said respective threaded ends of said anchor bolts within said cavity for rigidly securing said side frames on said respective steps, and opening in the top wall of said cavity, which openings respectively are coaxial with and of larger diameters than said holes in said bottom side of said cavity, whereby access to said nuts with a wrench may be made through said openings to remove said nuts from said anchor bolts and thereby permit said side frames to be removed from their respective steps, and removable plug means respectively closing each of said openings.

2. A structure as claimed in claim 1, said elastomer tread and seal having respective longitudinal edge portions overlying said bottom wall of each side frame, means on the upper side of said bottom wall and lower side of said edge portions for releasably securing said tread and seal to said side frames, said bottom wall of each side frame having a second series of longitudinally spaced openings therein which are spaced from said segment, and a plurality of additional downwardly depending anchor bolts having threaded ends extending respectively through said second series of openings, and nuts securing said last-mentioned anchor bolts to said bottom wall, means forming an upwardly facing, longitudinal channel on the upper side of said bottom wall beneath said longitudinal edge portions, said second series of openings extending through said bottom wall into said channel, and the uppermost of the last-mentioned nuts and the upper threaded ends of said additional anchor bolts being in a longitudinal cavity formed by said channel and the overlying longitudinal edge portions of said tread and seal.

3. A structure as claimed in claim 1, and an elongated, membrane-support member attached to and projecting laterally beyond the joint-remote longitudinal edge of each side frame, the laterally projecting part of said member comprising a diagonally depending, elongated body portion having a transversely concave upper surface adapted to support the joint-contiguous edge of water-impermeable membrane to be laid between the lower concrete layer and an upper wear course layer of concrete or asphalt and continued up to each of said side frames.

4. A structure as claimed in claim 3, and additional anchor bolts mounted on and extending downwardly from said body portion.

5. An expansion joint frame structure with an elastomer seal and tread comprising a pair of opposed, elongated, side frames adapted to be mounted on respective steps in the upper corners of a pavement or a bridge deck expansion joint, an elongated elastomer seal removably mounted on said side frames and extending therebetween, said side frames each having a bottom wall adapted to rest on a step in the pavement or bridge deck in the respective upper corners of the joint and further having a joint-remote, elongated segment of substantially rectangular transverse cross section with a longitudinal cavity of substantially rectangular cross section therein, the bottom side of said cavity having a first series of longitudinally spaced holes through which protrude respective threaded ends of downwardly extending anchor bolts, nuts threaded on respective threaded ends of said anchor bolts within said cavity, openings in the top wall of said cavity, which openings respectively are coaxial with and of larger diameters than said holes in said bottom side of said cavity, whereby access to said nuts with a wrench may be made through said openings, removable plug means respectively closing each of said openings, an elongated membrane-support member attached to and projecting laterally beyond the joint-remote longitudinal edge of each side frame, the laterally projecting part of said member comprising a diagonally depending, elongated body portion having a transversely concave upper surface adapted to support the joint-contiguous edge of a wter-impermeable membrane to be laid between the lower concrete layer and an upper wear course layer of concrete or asphalt and continued up to each of said side frames, each of said members having a longitudinal flange beneath the joint-remote longitudinal edge of the bottom wall of respective side frames, said flange having a series of longitudinally spaced holes aligned with said first series of longitudinally spaced holes, the threaded ends of said first-mentioned anchor bolts also extending through the respective holes in said flange, and nuts threaded on said bolts to mount the flange of each member rigidly on respective side frames.

6. An expansion joint frame structure comprising an elongated frame mounted on a step in the upper corner of an expansion joint of pavement or a bridge deck, said pavement or bridge deck having a lower layer of concrete and an upper wear course layer of asphalt or concrete, a water impermeable membrane laid between said layers, an elongated, membrane support member attached to and projecting laterally and downwardly beyond the joint-remote, longitudinal edge of said side frame, the laterally projecting part of said member comprising an elongated body portion having a transversely curvate, concave upper surface with a transverse curvature extending vertically downwardly from the lower, joint-remote corner of said frame and then progressively in a shallow curve to a horizontal, joint-remote, longitudinal edge of said upper surface, and the joint-contiguous edge portion of said membrane lying on said transversely concave upper surface and extending curvately from said horizontal, joint-remote, longitudinal edge of said upper surface up to and against the joint-remote, longitudinal edge of said side frame.

7. A structure as claimed in claim 6, and anchor bolts mounted on and extending diagonally downwardly and outwardly from said body portion.

8. An expansion joint frame structure comprising an elongated side frame adapted to be mounted removably on a step in the upper corner of an expansion joint of pavement or a bridge deck by vertically extending anchor bolts anchored in the joint, said side frame having a bottom wall adapted to rest on the step in the pavement or bridge deck in the upper corner of the joint and further having a joint-remote, longitudinal segment forming with said bottom wall a longitudinal cavity, the bottom wall having a first series of longitudinally spaced holes opening into said cavity, through which holes protrude the respective threaded upper ends of downwardly extending anchor bolts, nuts threaded on said respective thread ends of said anchor bolts within said cavity for rigidly securing said side frames on said respective steps, and said cavity having a top wall having openings therein permitting access to said nuts with a wrench to remove said nuts from said anchor bolts and thereby permit said side frames to be removed from their respective steps, and removable means respectively closing each of said openings.

* * * * *

UNITED STATES PATENT AND TRADEMARK OFFICE

CERTIFICATE OF CORRECTION

PATENT NO. : 4,063,839

DATED : December 20, 1977

INVENTOR(S) : Delmont D. Brown

It is certified that error appears in the above-identified patent and that said Letters Patent are hereby corrected as shown below:

Column 7, line 14, "removable" should read --removably--
line 28, "opening" should read --openings--
line 64, after "of" insert --a--

Column 8, line 32, "wter-" should read -- water- --.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*